US005636937A

United States Patent [19]

Zemlicka

[11] Patent Number: 5,636,937

[45] Date of Patent: Jun. 10, 1997

[54] UNIVERSAL CONNECTOR ANCHOR

[75] Inventor: Alvin R. Zemlicka, Elkhart Lake, Wis.

[73] Assignee: Harley-Davidson Motor Company, Milwaukee, Wis.

[21] Appl. No.: 298,119

[22] Filed: Aug. 30, 1994

[51] Int. Cl.[6] ..... H01R 13/66

[52] U.S. Cl. ..... 403/388; 248/71; 248/222.11; 248/223.41; 248/912; 403/4; 439/567

[58] Field of Search ..... 248/71, 187, 221.11, 248/222.11, 223.41, 224.51, 558, 912; 403/3, 4, 384, 386, 388; 439/542, 567, 571

[56] References Cited

U.S. PATENT DOCUMENTS

| | | | |
|---|---|---|---|
| 4,618,915 | 10/1986 | Bury | 248/221.3 X |
| 4,669,803 | 6/1987 | Kim | 439/571 |
| 4,813,642 | 3/1989 | Matsui | 248/221.3 |
| 4,943,244 | 7/1990 | Teck et al. | 439/571 X |
| 5,203,529 | 4/1993 | Penniman | 248/221.3 X |
| 5,257,948 | 11/1993 | Peterson | 439/571 |

*Primary Examiner*—Blair Johnson
*Assistant Examiner*—Andrea Chop
*Attorney, Agent, or Firm*—Michael, Best & Friedrich

[57] ABSTRACT

A universal anchor for securing electrical connectors to a motor vehicle includes a body portion and a stem portion extending downwardly from the body portion. The stem portion is constructed and arranged for being secured in an opening in a motor vehicle. The body portion includes a first mount having a first upper surface and a pair of parallel, spaced apart rails disposed the lateral sides of the first surface. A first locking member is disposed on the first upper surface and between the rails for being engaged by locking means on a connector to be mounted thereon. The body portion also includes a second mount defined by an elongated portion projecting from the first mount and having a second upper surface formed thereon and a flange is mounted along each lateral side of the second upper surface. Second and third locking members are disposed on the second mount and spaced apart in a longitudinal direction. The second locking member extends above the second upper surface and the third locking member is disposed below the second upper surface.

11 Claims, 2 Drawing Sheets

UNIVERSAL CONNECTOR ANCHOR

BACKGROUND OF THE INVENTION

This invention relates to anchors for electrical connectors and in particular those used on motor vehicles such as motorcycles.

Motor vehicles, such as motorcycles, include a plurality of electrical connectors for various electrical components. Each connector must be mounted on the frame or other structural member by means of an anchor. In prior art motorcycles, such as those manufactured by Harley Davidson, Inc., different electrical connectors required differently configured anchors so that it was necessary to stock several different anchors for each vehicle. Moreover, certain electrical connectors were mounted on the vehicle by means of a metallic stud welded into the frame or other structural component. Should the stud break, considerable effort was required to remove the broken stud before a new anchor could be mounted.

SUMMARY OF THE INVENTION

It is an object of the invention to provide a new and improved anchor for attaching electrical connectors to motor vehicles.

Another object of the invention is to provide a universal anchor capable of attachment to different types of electrical connectors.

A further object of the invention is to provide an electrical connector that readily permits a new anchor to be mounted should the original anchor fail.

These and other objects and advantages of the invention will be apparent from the detailed description thereof with the accompanying drawings.

In general terms, the invention comprises a universal anchor for securing electrical connectors to a motor vehicle. The anchor includes a body portion and a stem portion extending perpendicularly therefrom, the stem portion being constructed and arranged for being secured in an opening in the motor vehicle. The body portion includes a first mount including a first pair of parallel, spaced apart mounting means and a first locking means disposed between the rails for and being engaged by the locking means on a connector to be mounted on the anchor. The body portion also includes a second mount defined by an elongate portion projecting from the first mount and having a second pair of parallel, spaced apart mounting means and second and third locking means spaced apart in a longitudinal direction, one locking means being located above a plane parallel to the second pair of mounting means and the other being disposed below said plane.

DETAILED DESCRIPTION OF THE PREFERRED EMBODIMENT

Figure 1:
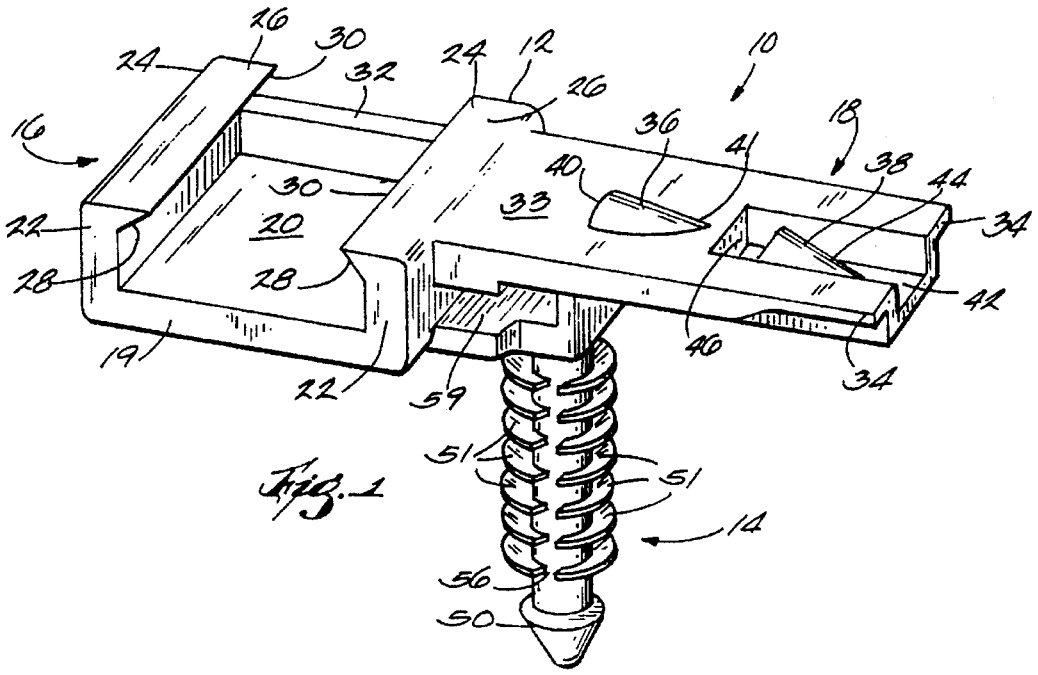
FIG. 1 is a prospective view showing the universal anchor according to the preferred embodiment of the invention.

FIG. 1 shows a universal anchor 10 according to the preferred embodiment of the invention for mounting various electrical connectors to the frame or other structural components of a motor vehicle such as a motorcycle. The connection 10 includes a body portion 12 and a stem portion 14. The body portion 12 includes a first mount 16 located generally on one side of the stem 14 and a second mount 18 integral with the mount 16 and located generally on the other side of the stem 14.

The first mount 16 includes a base 19 having a generally planar upper surface 20 and a pair of generally parallel, side walls 22 extending upwardly along the lateral sides of surface 20. A mounting rail 24 is disposed at the upper end of each side wall 22 and each is defined by an upper surface 26 and an obliquely extending lower surface 28 which intersect at an acute angle to form an edge 30. At the rear of the surface 20 and extending perpendicularly to the side walls 22 is a first locking member 32 which extends perpendicularly upwardly from the surface 20 and between the side walls 22 and terminates below the rails 24.

The second mount 18 comprises an elongate projection having an upper surface 33 and a pair of mounting flanges 34 extending along each lateral side thereof. There is also a first locking member 36 extending above the surface 33 and a second locking member 38 disposed below the surface 33. The locking members 36 and 38 are spaced apart longitudinally between the flanges 34. The first locking member 36 comprises a convex projection having a flat surface 40 at its inner end and which tapers therefrom to a point 41 at its opposite end.

The second locking member 38 is disposed between the lateral sides of a groove 42 formed in surface 33 and open at the free end of mounting portion 18. Locking member 38 includes a ramp surface 44 which is inclined upwardly away from the open end of groove 42 and terminates below the surface 33 and short of the end of groove 42 to define a gap 46 therebetween. It can be seen that the first locking member 36 is above the plane defined by the upper surface 33 and the second locking member 38 is below this plane.

The stem 14 includes a conical tip 50 and a plurality of thin flexible teeth 51 which are inclined upwardly and away from the tip 50. In addition, there is a pair of grooves 56 extending longitudinally on the opposite side of the stem 14 through teeth 51 to permit the teeth to distort inwardly. It will be appreciated that the teeth 51 will permit the stem 14 to be inserted into a hole 58 in a motorcycle frame or structural part and having a diameter slightly smaller than the outside diameter of the teeth 51 and a depth less than the length of stem 14. As a result, the teeth distort inwardly as the anchor is inserted into hole 58 and then return to their undistorted condition after passage completely through the hole 58 to provide a ratcheting effect thereby permitting insertion but resisting removal of the stem 14 from the hole 58 as seen in FIG. 4.

The anchor 10 is formed of a suitable plastic material so that should the stem 14 fail while in the hole 58, the remnants can easily be removed and a new anchor be fixed in place.

In addition, a rectangular hole 59 is formed in the body portion 12 above the stem 14 and at the junction of the mounts 16 and 18. This permits the anchor 10 to be secured to the vehicle frame by means of a strap or tie should the stem 14 break away or should the mounting hole be plugged. In the latter event, the stem 14 would first be broken away.

Figure 2:
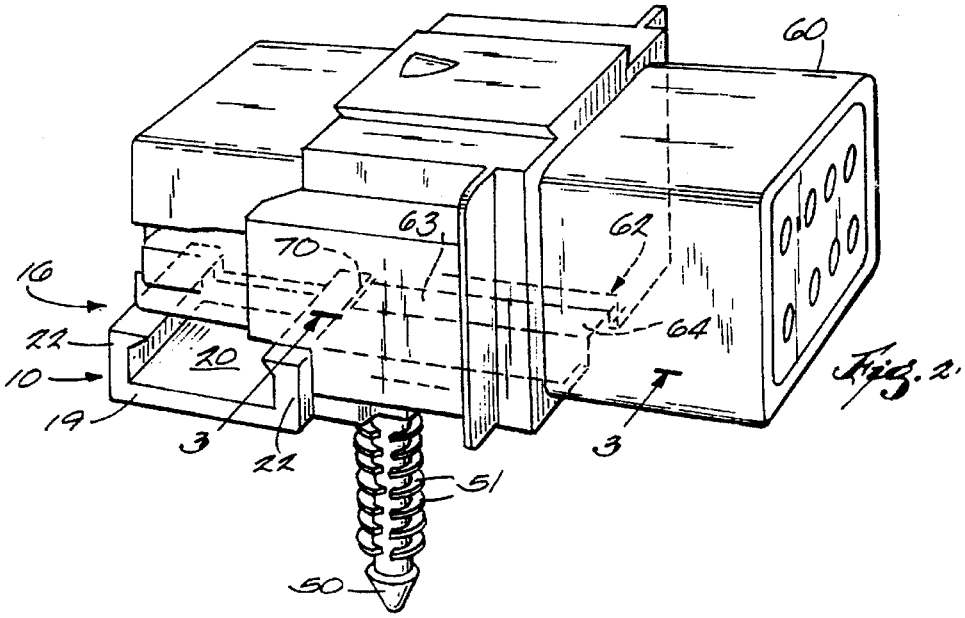
FIG. 2 is a perspective view showing the anchor of FIG. 1 with a first type of electrical connector mounted thereon.
Figure 3:
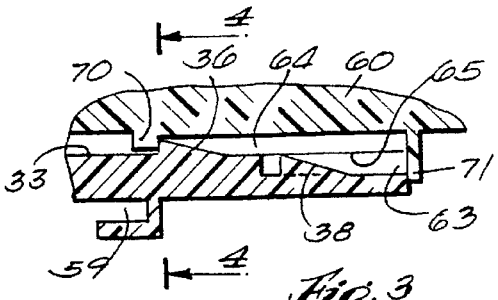
FIG. 3 is a partial sectional view taken along lines 3—3 of FIG. 2.
Figure 4:
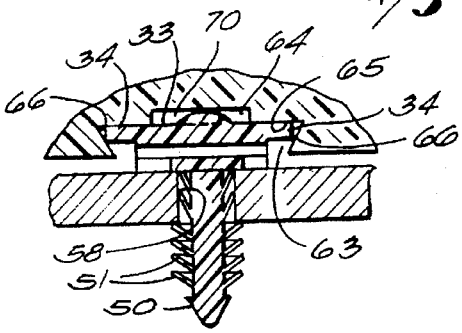
FIG. 4 is a partial sectional view taken along lines 4—4 of FIG. 3.

FIGS. 2–4 show a first well known type of an electrical connector 60 used on motor vehicles, such as motorcycles. The connector 60 includes a mounting portion 62 disposed on its lower extremity and consisting of a slot 63 and a groove 64. The slot 63 is defined by a surface 65 and a pair of inwardly extending side surfaces 66 to define mounting means complimentary to the mounting flanges 34. The groove 64 extends longitudinally along the center of surface 65 and terminates at its inner end in a downwardly extending stop 70.

As seen in FIG. 4, the width of the surface 65 on connector 60 is slightly larger than that of the surface 33 on anchor 10 while the distance between the surfaces 66 at their lower ends is slightly less than the width of surface 33. Accordingly, the second mount 18 and particularly flanges 34 are receivable in the slot 63 and is secured from movement perpendicular to the surface 65 by the inwardly extending surfaces 66. As the second mount 18 moves along slot 63, the locking member 36 which extends above the surface 33 rides beneath the stop 70 as the flexible plastic material of the flanges 34 distort slightly. When the end face 40 of member 36 moves past the stop 70, the flanges 34 return to their original shape thus locking the connector together as shown in FIGS. 3 and 4. Further movement of connector 60 on anchor 10 is arrested by stops 71 at the forward end of slot 63.

Figure 5:
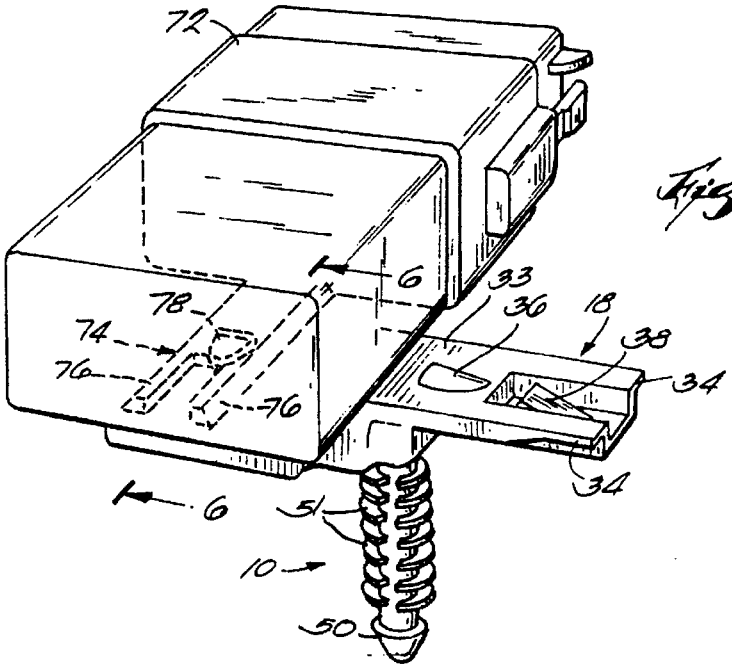
FIG. 5 is a perspective view showing the anchor of FIG. 1 with a second type of electrical connector mounted thereon.
Figure 6:
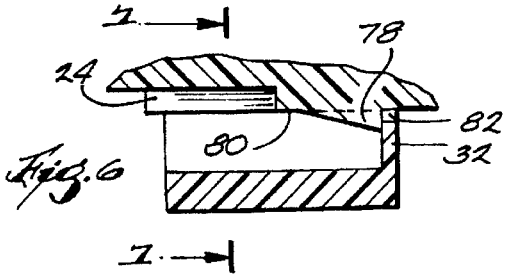
FIG. 6 is a partial sectional view taken along lines 6—6 of FIG. 5.
Figure 7:
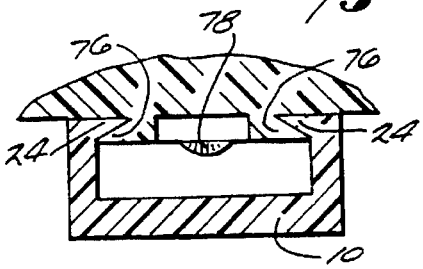
FIG. 7 is a partial sectional view taken along lines 7—7 of FIG. 6.

FIGS. 5, 6 and 7 show a second well known type of an electrical connector 72 used on motor vehicles such as motorcycles. The electrical connector 72 includes a mounting portion 74 consisting of a pair of parallel mounting rails 76 which are complimentary to the mounting rails 24 on anchor 10. As a result, the two interlock as shown in FIG. 7 as the connector 72 is slid onto the first mount 16 of anchor 10. Connector 72 also has a locking member 78 extending downwardly from the lower surface 80 and generally between the rails 76. Locking member 78 is substantially identical to locking member 36 and includes a rear locking surface 82. As the connector 72 is moved along rails 24, the locking member 78 rides up and over locking member 32 and then snaps into a locked position as the surface 82 engages locking member 32 as shown in FIG. 6.

Figure 8:
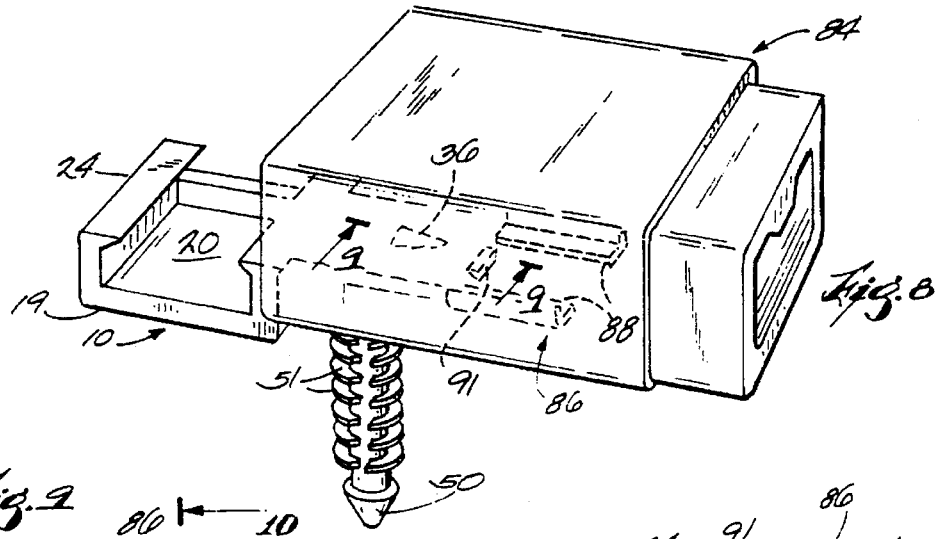
FIG. 8 is a perspective view showing the anchor of FIG. 1 with a third type of electrical connector mounted thereon.
Figure 9:
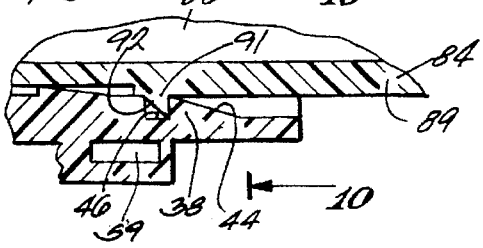
FIG. 9 is a partial sectional view taken along lines 9—9 of FIG. 8.
Figure 10:
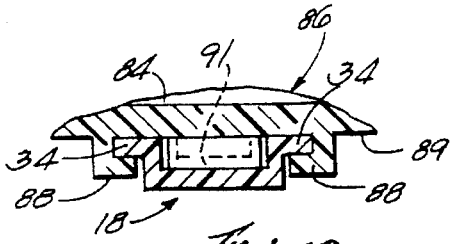
FIG. 10 is a partial sectional view taken along lines 10—10 of FIG. 9.

FIGS. 8, 9 and 10 show a third well-known type of electrical connector 84 used on motor vehicles such as motorcycles. The electrical connector 84 includes a mounting portion 86 which includes a pair of L-shaped mounting rails 88 extending downwardly from the lower surface 89 of connector 84. The rails 88 are arranged in a parallel spaced apart relation and are sized for receiving the mounting flanges 34 of mount 18 therebetween. Extending downwardly from the surface 89 and positioned centrally of the rails 88 is a downwardly projecting member 91 having an oblique lower surface 92. As the connector 84 is slid along the anchor rails 34, the oblique surface 92 rides up the inclined surface 44 until the lower end of the projecting member 91 moves into the slot 46. This locks the connector 84 against removal from the anchor 10.

While only single embodiment of the invention has been illustrated and described, it is not intended to be limited thereby but only by the scope of the appending claims.

I claim:

1. A universal anchor for securing electrical connectors to a motor vehicle, said anchor including a body portion and a stem portion extending downwardly from the body portion, said stem portion being constructed and arranged for being secured in an opening in a motor vehicle, said body portion including a first mount having a first upper surface, said first upper surface having a pair of lateral sides, a pair of parallel, spaced apart elongate rails mounted on said first mount and spaced from the lateral sides of said first upper surface and a first locking means disposed on said first upper surface and disposed between and spaced from said rails for being engaged by a first locking means on a connector to be mounted thereon, said body portion including a second mount defined by an elongated portion projecting from said first mount and having a second upper surface formed thereon, said second upper surface being spaced from said first upper surface and having a pair of lateral sides, a pair of elongate flanges spaced from said rails and extending along said second upper surface, second and third locking means disposed on said second mount between and spaced from said flanges and spaced apart in the direction that said second mount projects from said first mount, said second locking means extending above said second upper surface and said third locking means being disposed below said second upper surface.

2. The universal anchor set forth in claim 1 wherein said first mount includes a pair of parallel, spaced apart sidewalls extending upwardly from said first upper surface and having an upper end, said rails being disposed at the upper end of said side walls, said first locking means extending perpendicularly between said sidewalls.

3. The universal anchor set forth in claim 1 wherein said second mount has an end remote from said first mount, said second locking means including a member having a first end disposed toward the remote end of the second mount and a second end disposed toward the first mount, said member having a first end at said second upper surface tapering upwardly from said first end to said second end, said second end being defined by a surface generally perpendicular to said second upper surface.

4. The universal anchor set forth in claim 1 wherein teeth means are formed in said stem portion for anchoring said universal anchor in a hole on the motor vehicle having a depth less than the length of said stem portion.

5. A universal anchor for securing electrical connectors to a motor vehicle, said anchor including a body portion and a stem portion extending downwardly from the body portion, said stem portion being constructed and arranged for being secured in an opening in a motor vehicle, said body portion including a first mount having a first upper surface, said first upper surface having a pair of lateral sides, a pair of parallel, spaced apart rails disposed along the lateral sides of said first upper surface and a first locking means disposed on said first upper surface and between said rails for being engaged by a first locking means on a connector to be mounted thereon, said body portion including a second mount defined by an elongated portion projecting from said first mount and having a second upper surface formed thereon, said second upper surface having a pair of lateral sides, a flange disposed along each lateral side of said second upper surface, second and third locking means disposed on said second mount and spaced apart in the direction that said second mount projects from said first mount, said second locking means extending above said second upper surface and said third locking means being disposed below said second upper surface, said first mount including a pair of parallel, spaced apart sidewalls extending upwardly from said first upper surface, said rails being disposed at the upper end of said side walls, said first locking means extending perpendicularly between said sidewalls, said second mount having an end remote from said first mount, a groove formed in said second upper surface and open at said remote end, said third locking means being disposed in said groove and including a ramp surface inclined upwardly from the open end of said groove and spaced from said first mount for receiving a locking member extending downwardly from an electrical connector to be mounted on said second mount.

6. A universal anchor for securing electrical connectors to a motor vehicle, said anchor including a body portion and a stem portion extending downwardly from the body portion, said stem portion being constructed and arranged for being secured in an opening in a motor vehicle, said body portion including a first mount having a first upper surface, said first upper surface having a pair of lateral sides, a pair of parallel, spaced apart rails disposed along the lateral sides of said first upper surface and a first locking means disposed on said first upper surface and between said rails for being engaged by a first locking means on a connector to be mounted thereon, said body portion including a second mount defined by an elongated portion projecting from said first mount and having a second upper surface formed thereon, said second upper surface having a pair of lateral sides, a flange disposed along each lateral side of said second upper surface, second and third locking means disposed on said second mount and spaced apart in the direction that said second mount projects from said first mount, said second locking means extending above said second upper surface and said third locking means being disposed below said second upper surface, said second mount having an end remote from said first mount, said second locking means including a member having a first end disposed toward the remote end of the second mount and a second end disposed toward the first mount, said member tapering upwardly from said first end to said second end, said second end being defined by a surface generally perpendicular to said second upper surface, a groove formed in said second upper surface and open at said remote end, said third locking means being disposed in said groove and including a ramp surface inclined upwardly from the open end of said groove and spaced from said first mount for receiving a locking member extending downwardly from an electrical connector to be mounted on said second mount.

7. The universal anchor set forth in claim 6 wherein said first mount includes a pair of parallel, spaced apart sidewalls extending upwardly from said first upper surface, said first locking means extending perpendicularly between said sidewalls.

8. The universal anchor set forth in claim 7 wherein teeth means are formed on said stem portion for anchoring said universal anchor in a hole in the motor vehicle having a depth less than the length of said stem portion.

9. A universal anchor for securing electrical connectors to a motor vehicle, said anchor including a body portion and a stem portion extending downwardly from the body portion, said stem portion being constructed and arranged for being secured in an opening in a motor vehicle, said body portion including a first mount, first mounting means disposed on said first mount for engagement with complimentary mounting means on a first connector adapted to be mounted thereon, a first locking means disposed on said first mount for being engaged by a locking means on a connector adapted to be mounted on said first mounting means, said body portion including a second mount spaced from said first mount, said second mount including a second mounting means configured differently than said first mounting means for engagement with complimentary mounting means on a second connector adapted to be mounted on the second mounting means and a second locking means disposed on said second mount for engaging a second locking means on the second connector, said second mount having an upper surface an end remote from said first mount, said second locking means including a member having a first end disposed toward the remote end of the second mount and a second end disposed toward the first mount, said member extending upwardly from said second mount and tapering upwardly from said first end to said second end, said second end being defined by a surface generally perpendicular to said upper surface, a groove formed in said upper surface and open at said remote end, said groove having an inner end displaced from its open end, a third locking means disposed in said groove and including a ramp surface inclined upwardly from the open end of said groove and spaced from the inner end of said groove for receiving a third locking means extending downwardly from an electrical connector adapted to be mounted on said second mount.

10. The universal anchor set forth in claim 9 wherein said first mounting means including spaced apart mounting members, said first locking means extends perpendicularly between said mounting members.

11. The universal anchor set forth in claim 10 wherein said stem portion extends downwardly from said body portion and teeth means are formed on said stem portion for anchoring said universal anchor in a hole in the motor vehicle having a depth less than the length of said stem portion.

* * * * *